United States Patent [19]

Mohaupt

[11] Patent Number: 4,976,318

[45] Date of Patent: Dec. 11, 1990

[54] TECHNIQUE AND APPARATUS FOR STIMULATING LONG INTERVALS

[76] Inventor: Henry H. Mohaupt, 1151 Estrella Dr., Santa Barbara, Calif. 93110

[21] Appl. No.: 444,408

[22] Filed: Dec. 1, 1989

[51] Int. Cl.[5] ..... E21B 37/08; E21B 43/26

[52] U.S. Cl. ..... 166/311; 166/63

[58] Field of Search ..... 166/63, 299, 311; 102/312, 313

[56] References Cited

U.S. PATENT DOCUMENTS

| | | | |
|---|---|---|---|
| 2,362,829 | 11/1944 | Kinley | 166/63 X |
| 2,650,539 | 9/1953 | Greene | 166/63 X |
| 3,422,760 | 1/1969 | Mohaupt | 166/63 X |
| 4,064,935 | 12/1977 | Mohaupt | 166/63 |
| 4,315,797 | 2/1982 | Peppers | 166/63 X |
| 4,530,396 | 7/1985 | Mohaupt | 166/63 |
| 4,683,943 | 8/1987 | Hill et al. | 166/63 |
| 4,798,244 | 1/1989 | Trost | 166/299 X |
| 4,823,876 | 4/1989 | Mohaupt | 166/63 X |

*Primary Examiner*—Stephen J. Novosad

*Attorney, Agent, or Firm*—G. Turner Moller

[57] ABSTRACT

A gas generating type fracturing tool is designed to work on long productive intervals and includes a series of separate propellant charges, an igniter for initiating combustion of one of the charges and means for transferring combustion from one charge to the next. In one embodiment, combustion of the charges occurs one after another with little or no delay between successive charges. In other embodiments, a delay is incorporated in the combustion train between successive charges. Some embodiments are specifically designed to unplug uncemented slotted liners and have very small gas generation capability.

28 Claims, 3 Drawing Sheets

FIG. 1
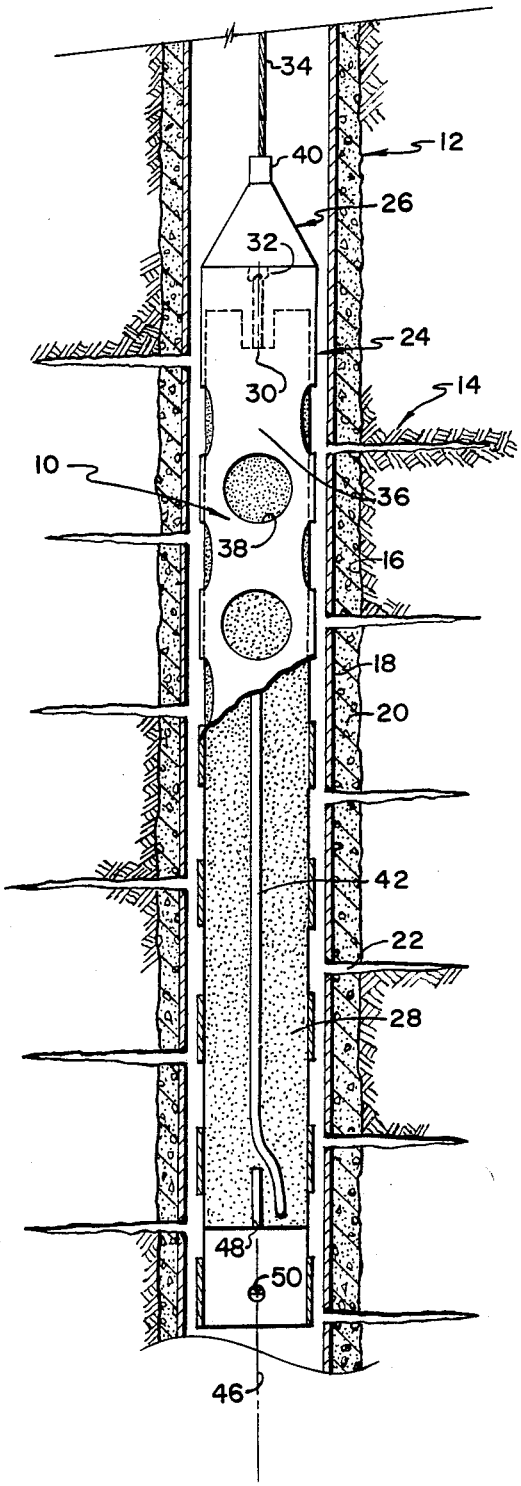
FIG. 2
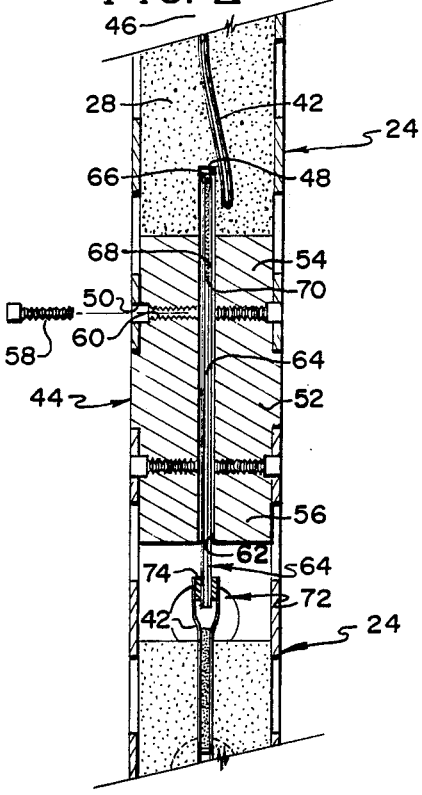
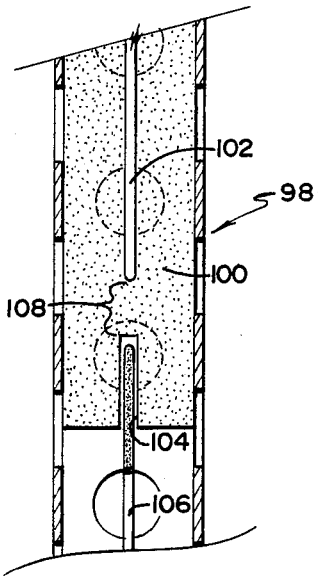
FIG. 4

FIG. 7
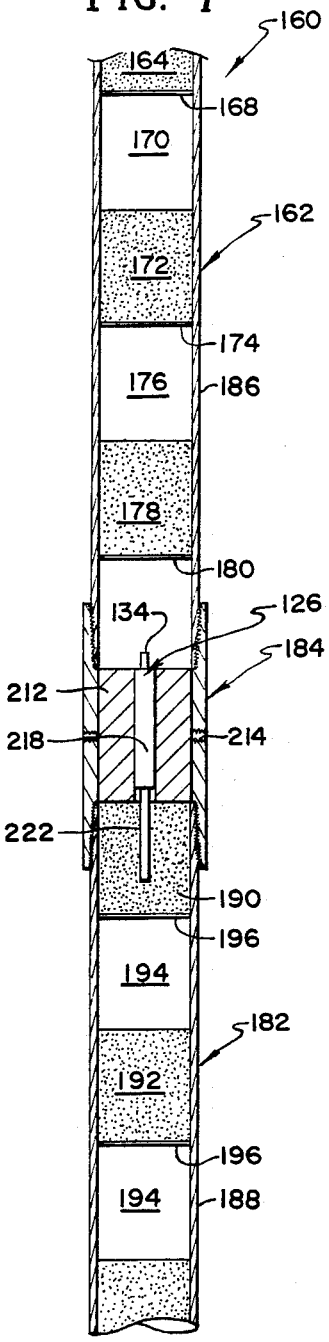
FIG. 8
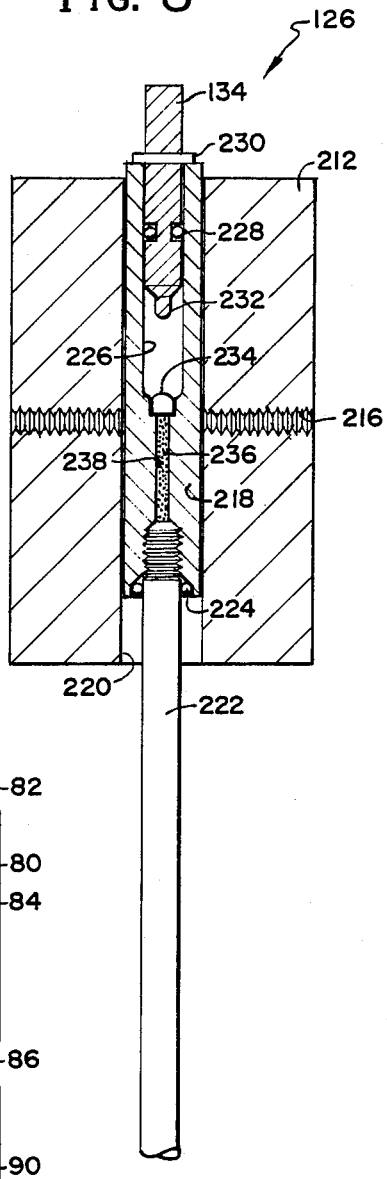
FIG. 10
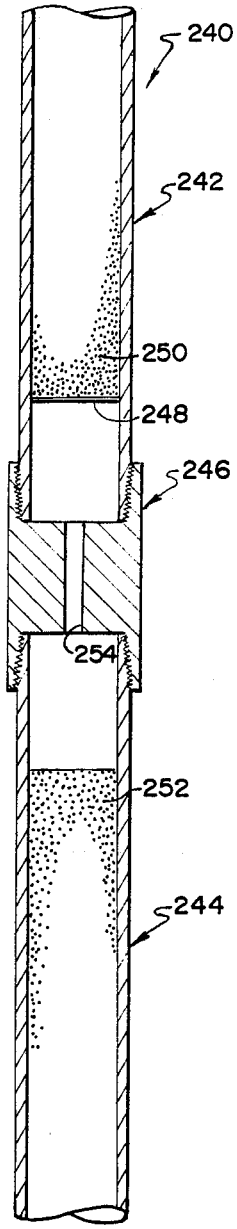
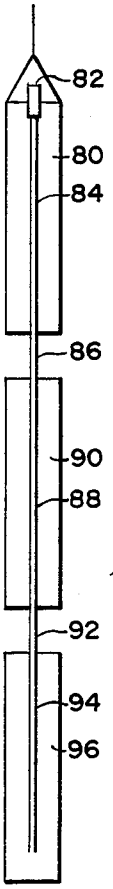
FIG. 3
FIG. 9
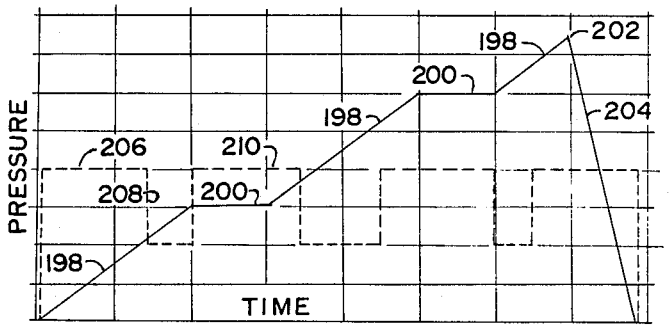

TECHNIQUE AND APPARATUS FOR STIMULATING LONG INTERVALS

This invention relates to a technique for stimulating a subterranean formation and more particularly to a device which employs a very long charge of propellant material which generates, during combustion, a large quantity of high pressure gases to stimulate a thick subterranean formation or a smaller quantity of high pressure gases to unplug perforations or a slotted liner.

There are several techniques for stimulating subterranean formations. The most common technique is "hydraulic fracturing" in which a liquid is injected into a formation carrying a large quantity of sand or other proppant. The liquid is pumped into the formation so rapidly that a temporary fracture is created. The proppant is deposited in the fracture and prevents it from completely closing at the cessation of pumping. Hydraulic fracturing works quite acceptably in a large variety of situations but indisputably has its disadvantages, foremost of which is cost. Hydraulic fracturing often requires the well be killed and the tubing pulled. In addition, hydraulic fracturing uses pump trucks, proppant material and a carrier liquid, all of which are more-or-less expensive depending on many factors.

Another technique for fracturing subterranean formations includes the detonation of an explosive charge in the well bore which fractures the formation by shattering or rubblizing. This technique is somewhat less expensive than hydraulic fracturing but has significant disadvantages. In its oldest form, explosive fracturing of a well is accomplished by placing one or more nitroglycerine charges in the well bore and then detonating them. Considerable damage is often done to casing in the well or considerable junk is left in the hole requiring significant effort to clean up the well and repair the damage done. Although more modern explosive fracturing techniques are available, these also suffer from the same disadvantages. The second disadvantage of explosive fracturing techniques involves the obvious danger in handling, transporting and detonating the explosive. Personnel of extensive training and experience are required for this technique and such are not always available.

A third type of well fracturing technique involves the use of a device incorporating a gas generating charge or propellant which is typically lowered into a well on a wire line and ignited to generate a substantial quantity of gaseous combustion products at a pressure sufficient to break down the formation adjacent the perforations. It is this type fracturing technique that this invention most nearly relates. This type fracturing differ from explosive fracturing in a number of respects (1) fracturing is caused by high pressure gaseous combustion products moving through and possibly eroding the formation rather than shock wave fracturing; and (2) the process is one of combustion rather than explosion which has numerous ramifications. For example, an explosion propagates through the explosive material by, and at the rate of, the shock wave that moves through the material. This causes explosive processes to propagate much faster than combustion, generate much higher pressures than combustion while the time for the reaction to be completed is much shorter. Typical disclosures of gas generating fracturing devices are found in U.S. Pat. Nos. 3,422,760; 3,602,304; 3,618,521; 4,064,935 and 4,081,031 and 4,823,876.

Present commercially available gas generation stimulation tools include an elongate propellant charge, usually but not necessarily in a perforated carrier, of a length to be easily handled. Thus, presently available tools are 10–25′ long. The propellant in these tools is typically ignited by an electrical signal transmitted through an insulated wire line to an assembly including an aluminum ignition tube having gunpowder or other ignition mixture therein. The electrical signal starts an igniter which starts the gunpowder burning. The gunpowder burns through the length of the ignition tube and starts the propellant burning.

There is occasionally a requirement to stimulate a thick subterranean formation which cannot be adequately stimulated by the operation of one of the presently available tools. In such circumstances, a wide variety of techniques have heretofore been employed or proposed. Such techniques include, for example, dumping a large quantity of bulk propellant material into the well, allowing it to settle to the bottom and then igniting it by one method or another It will be appreciated that there is little one can do to control such a technique.

Gas generatinq tools have been proposed and used to unplug long slotted liners. It has been observed that long gas generators activated in wells to unplug liners often damage the slotted liner. It has been noticed that this damage often recurs at similar spaced intervals. It is believed that this recurrent damage is caused by periodic pressure peaks of sufficiently high magnitude to damage the well casing or liner by splitting it. In practice, it has been observed that an uncemented 5½″ slotted liner showed splits at intervals of 8–9 feet over 40 feet after being subjected to propellant gases generated by a ¼″ OD tool. This periodic damage can occur with small OD gas generators as well as larger diameter tools. It has now been determined that these periodic pressure pulses in long tools can be overcome or eliminated if combustion is interrupted or delayed at more-or-less frequent intervals.

One embodiment of this invention comprises a method and apparatus of unplugging a long slotted liner comprising igniting a propellant charge having the capacity of delivering less than about 1000 cubic inches of gas, measured at standard pressures and temperatures, per linear foot of charge and periodically interrupting the combustion of the propellant charge.

Another embodiment of this invention comprises a method of treating a subterranean formation comprising lowering into the well a tool comprising first, second and third discrete propellant charges and igniting a first of the charges and then igniting the second charge from the combustion products of the first charge and then igniting the third charge from the combustion products of the second charge at a time when the first charge is still burning. The embodiment of this invention used to perform this method comprises an apparatus for stimulating a subterranean formation penetrated by a well bore, comprising a series of elongate vertically spaced propellant charges for generating a large quantity of high pressure gaseous combustion products, an igniter for initiating combustion of a first of the propellant charges in including an ignition tube having a combustible material therein, the ignition tube extending axially substantially though the first charge and means for transmitting combustion of the first charge to a second of the charges, including a combustion transferring tube extending into the first change and extending into the second charge and having a combustible material therein.

Another embodiment of this invention is a method of cleaning an uncemented slotted liner suspended in a well bore penetrating a subterranean formation, comprising lowering a running liner having a plurality of openings therein into the slotted liner, lowering a propellant charge inside the running liner into the slotted liner, igniting the propellant charge and producing a quantity of high pressure combustion products, delivering the combustion products through the openings of the running liner and throttling the pressure of the combustion products, and delivering the combustion products through the openings of the slotted liner.

It is accordingly an object of this invention to provide an improved technique for stimulating a thick subterranean formation by use of a long propellant charge.

Another object of this invention is to provide a technique for stimulating a thick subterranean formation by sequentially igniting successive propellant charges.

Other objects and advantages of this invention will become more fully apparent as this invention proceeds, reference being made to the accompanying drawings and appended claims.

IN THE DRAWINGS

FIG. 1 is a side view, partly in cross-section of a tool of this invention;

FIG. 2 is an enlarged cross-sectional view of the connection between adjacent sections of the tool of this invention;

FIG. 3 is a schematic of a long tool of this invention;

FIG. 4 is a partial enlarged cross-sectional view of another embodiment of the tool of this invention;

FIG. 7 is a cross-sectional side view of another embodiment of this invention;

FIG. 8 is an enlarged cross-sectional view of the connection between adjacent sections of the tool of FIG. 7;

FIG. 9 is a pressure-time diagram of the tool of FIGS. 7 and 8; and

FIG. 10 is a cross-sectional view, similar to FIG. 6, of another embodiment of this invention.

Figure 5:
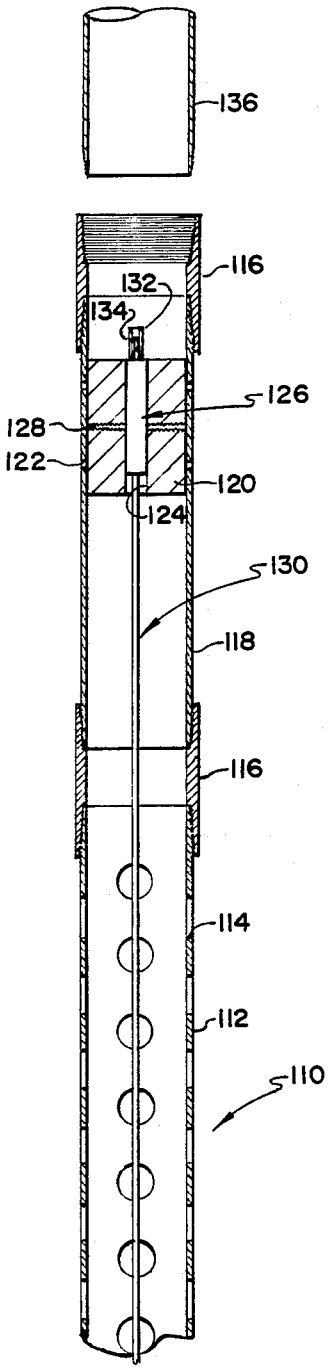
FIG. 5 is a side view, partly in cross-section of another embodiment of this invention.

Referring to FIG. 1, there is illustrated a gas generating tool 10 lowered inside a well 12 which penetrates a formation 14 to be fractured. The well 12 includes a bore hole 16 and a casing string 18 cemented in the bore hole 16 by a cement sheath 20. A multiplicity of perforations 22 have been formed between the formation 14 and the interior of the casing string 18 as is customary in the art.

The gas generating tool 10 comprises a frame or carrier section 24 connected to a cable head assembly 26 and receiving a charge 28 of propellant material. An igniter 30 includes a pair of wires 32 connected to a conductor cable or wire line 34. The wire line 34 suspends the tool 10 in the well 12 and delivers an electrical signal through the wires 32 to activate the igniter 30 thereby initiating combustion of the propellant change 28.

The carrier or frame 24 comprises an elongate rigid metallic tubular member or housing 36, open at both ends, having many laterally facing openings 38 arranged symmetrically along the tubular member. The openings 38 comprise a series of staggered openings spaced longitudinally along the tubular member 36. Typically, the housing 36 has a wall thickness on the order of $\frac{1}{4}$–$\frac{3}{8}$". The carrier 24 is open to liquids in the casing string 18. In addition, the openings 38 allow the gaseous high pressure combustion products to escape from the propellant charge 28. The cable head 26 may include a collar locator 40 to facilitate positioning of the tool 10 at a desired location, as is well known in the art.

The propellant charge 28 contains a fuel and an oxidizer. The fuel is conveniently in a resin form polymerized into a unit. Typically, the oxidizer components are water soluble. In this event, the resin polymer is preferably of a water insoluble type so that the liquid in the well 12 does not attack the propellant charge 28. In the alternative, the propellant charge 28 may be painted so it is not attacked by well fluids. Because the propellant 28 is inside the tubular housing 36, there is no danger of the charge 28 bowing and thereby becoming stuck inside the casing 18 or tubing through which it may be run.

The igniter 30 may be conventional and includes a section of thin wall aluminum ignition tube 42 having gun powder or other fast burning material therein. When the igniter 30 is energized through the wires 32, it combusts thereby raising the temperature of the propellant 28 adjacent thereto. This causes the propellant 28 to begin burning thereby liberating high pressure gaseous combustion products through the openings 38. These high pressure gases create a large bubble adjacent the formation and begin to raise the liquid column in the casing 18. The combustion gases pass through the perforations 22 into the formation and erode enlarged passages therein. In modern prior art tools, when the propellant 28 in the tool 10 finishes burning, the pressure adjacent the tool 10 declines, the gaseous bubble deflates, the liquid column falls back into the bottom of the casing string and the stimulating technique is over. Those skilled in the art will recognize the tool 10, as heretofore described, to be typical of commercially available gas generating type fracturing tools.

In situations where very long intervals are desired to be stimulated, the tool 10 must necessarily be very long. Because a tool 10 several hundred feet long cannot realistically be transported any significant distance to the well 12, the only realistic option is to make the tool into segments of a shippable length and assemble the segments at the well location. This requires some technique to transfer combustion from one propellant charge to the next.

To these ends, the tool 10 includes a plurality of the carrier or frame sections 24 secure together by a connector 44. As shown best in FIGS. 1 and 2, the lower end of the carrier section 24 is modified to mesh with the connector 44. The bottom end of the ignition tube 42 is embedded in the propellant 28 at a location offset relative to the tool axis 46. The bottom end of the propellant 28 provides a downwardly facing blind opening 48. The bottom end of the carriers 24 provide one or more bolt openings 50 as do the upper end of the lower carriers 24.

The connector 44 includes a substantial metallic body 52 symmetric about a central plane having an upper end 54 received in the lower end of the upper carrier 24 and a lower end 56 received in the upper end of the lower carrier 24. Threaded fasteners 58 are inserted through upper and lower bolt openings 50 in the carriers 24 to engage interiorally threaded openings 60. A mechanical connection between the carrier sections 24 is thus provided.

The connector 44 also includes an axial passage 62 having loosely received therein a thin walled aluminum combustion transfer tube 64 having a sealed upper end 66, an ignition mix 68 and a partition 70 made of paper, fiberboard or the like supporting the ignition mix 68 leaving the bottom of the tube 64 empty. The bottom of the tube 64 extends into a seal 72 located in the upper end of the frame 24 above the top of the propellant charge 28 thereof. The seal 72 may be of any suitable type to prevent liquid entry into the lower end of the transfer tube 64 while allowing the passage of hot combustion products axially through the tube 64. Preferably, the seal 72 comprises a resilient annular plug 74 received in an enlarged diameter section 76 of the ignition tube 42 placed axially in the propellant charge 28 of the next subjacent tool section. The tool 10 of this invention may comprise as many of the carrier sections 24 as is necessary to span the distance between the uppermost and lowermost perforations of the formation 14 to be stimulated. The lowermost carrier section includes a bull plug (not shown) at the lower end thereof, as is customary in the art.

Assembly of the tool 10 should now be apparent. The lowermost carrier section 24 is lowered into the well 12 and supported by slips in the rotary table of the workover rig (not shown) used to pull tubing and the like from the well 10. The connector 44 is inserted into the top of the lower carrier 24 and bolts 58 inserted through openings 50 and threaded into the passages 60. The transfer tube 64 is passed through the passage 62 so the lower end passes through the central opening of the annular resilient seal 74. The upper carrier 24 is then lowered onto the connector 44 so the transfer tube 64 extends into the blind opening 48. With the upper carrier 24 received on the upper end 54 of the connector 44, the bolts 58 are threaded into the openings 60.

When the tool 10 is lowered into the well 12 and the igniter 30 energized, combustion is started in the ignition tube 42 of the upper carrier 24. Combustion of the upper propellant charge 28 begins along substantially the entire length of the charge 28 and the charge 28 burns radially away from the axis of the upper ignition tube 42. When the flame front reaches the blind passage 48 at the lower end of the carrier 24, the upper end of the transfer tube 62 melts or burns to ignite the ignition mix 68. Hot combustion products from the ignition mix 68 and possibly from the propellant charge 28 in the upper carrier 24 pass through the transfer tube 64 and through the seal 72 into the ignition tube 42 of the next lower tool section to ignite the next lower propellant charge 28.

As is apparent, the tools of this invention may be of any desired length. One of the peculiarities of this invention is shown best in FIG. 3 where a tool 78 comprises an upper tool section 80 ignited by an igniter 82 and having an ignition tube 84 extending substantially therethrough in combustion transferring relation with a transfer tube 86. The transfer tube 86 communicates with an ignition tube 88 of a second tool section 90 which, in turn, communicates with a transfer tube 92. The transfer tube 92 connects to an ignition tube 94 of a third tool section 96. Combustion products from the first tool section 80 and/or transfer tube 86 ignites the second tool section 90 and combustion products from the second tool section 90 and/or transfer tube 92 ignites the third tool section 96 at a time when the first tool section 80 is still burning. Thus, the pressure generated by the tool sections 80, 90, 96 can be added because they are all burning at the same time.

In the embodiment of FIGS. 1–3, ignition of the tools 10, 78 proceeds rather rapidly because there are no delays or interruptions designed into the combustion train. This may be desirable in many well situations. On the other hand, there are situations where it is desirable to delay combustion of one or more successive propellant charges.

One simple technique for introducing a delay into the combustion transfer between successive propellant charges is shown in FIG. 4 where a tool section 98 includes a propellant charge 100 having an ignition tube 102 axially spaced from the end of an axial blind passage 104 having a transfer tube 106 therein. Because the axial dimension 108 is substantially greater than the radial distance between the tube 42 and the blind passage 48 in FIG. 2, there is a delay approximately equal to the distance 108 divided by the combustion rate of the propellant charge 100. Looking at the embodiment of FIG. 4 in a slightly different perspective, combustion of the propellant charge 100 occurs radially adjacent the length of the ignition tube 102 and then turns to an axial burning mode through the axial dimension 108.

Referring to FIG. 5, there is illustrated another embodiment of this invention which is particularly adapted for use in cleaning plugged slotted liners or plugged perforations. A running liner 110 preferably comprises joints 112 of standard oil field tubing, such as $2\frac{7}{8}''$ OD tubing, having a multiplicity of slots or openings 114 therein. Adjacent joints are connected together by threaded couplings 116. The uppermost joint 112 of the running liner 110, illustrated in FIG. 5, connects to a firing head container 118 having a retainer housing 120 secured therein in any suitable manner, as by the use of set screws 122. The retainer housing 120 includes an axial passage 124 receiving an ignition assembly 126 secured therein by set screws 128.

The details of the ignition assembly 126 are shown in greater detail in FIG. 8 as will be explained more completely hereinafter. For present purposes, the igniter assembly 126 connects to an elongate small diameter gas generating tool 130 extending downwardly through the running liner 110. The running liner 110 is assembled in the slips of the rig (not shown) and run into the hole in a conventional manner. The tool 130 is likewise assembled and run into the running liner 110 as it is being run into the well. After a sufficient length of joints of the liner 110 and tool 130 have been run into the well, the firing head container 118 is attached to the coupling 116 and the ignition assembly 126 is attached to the tool 130 and secured in the retainer housing 120. A safety sleeve 132 is removed from the ignition assembly 126 to expose a piston 134. A coupling 116 is attached to the upper end of the container 118 and the assembly is run into well at the bottom of a tubing string 136 to a location adjacent the slotted liner to be unplugged.

The ignition assembly 126 can be activated in a variety of ways. A sinker bar (not shown) suspended on a wire line can be dropped into the tubing string 136 to strike the piston 134 and initiate combustion of the igniter assembly 126. A weight (not shown) may simply be dropped into the tubing string. In addition, the igniter assembly 126 can be started merely by pumping into the tubing string 136 from the surface to raise the pressure and hydraulically force the piston 134 downwardly.

A typical technique of completing a well is to cement casing at or near the top of a hydrocarbon producing zone, drill a bore hole horizontally or vertically into the producing and then run a slotted liner into the well bore without cementing the slotted liner in place. Over the years, openings in the slotted liner tend to become plugged with asphaltenes, formation fines and the like. It has been proposed and attempted in the past to unplug such slotted liners with gas generating tools. One of the peculiarities of gas generation tools is that they tend to split uncemented slotted liners at more-or-less repetitive intervals. It has been learned that such damage can be minimized or prevented by using very small capacity tools and then burning the propellant to produce a varying rate of gas generation. It has been learned that this technique is effective when the capacity of the tools is less than 1000 cubic inches of gaseous combustion products, measured at standard temperature and pressure, per linear foot of tool. Preferably, the capacity of the tool is less than 500 standard cubic inches of gaseous combustion products. Optimally, the tool produces about 300 standard cubic inches of gas or less. With gas volumes so small, the tool has to be submersed in liquid near the plugged slotted liner. The gas does not itself unplug the liner, it simply drives the well bore liquid through the plugged slotted liner to dislodge the asphaltene or fine plugs. The optimal tool 130 is ¼" OD having an ID of 0.183 inches. The volume of this tool is about 3.78 cubic inches per 12' length which is a preferred joint length. With typical propellants, the optimal tool 130 produces about 3024 cubic inches of gaseous combustion products measured at standard temperatures and pressures, per 12' joint or about 252 cubic inches of standard gaseous combustion products per linear foot of tool. This is a very small quantity of gas and, in the absence of liquid surrounding it, the tool ignites and makes an unimpressive "poof." With liquid surrounding the tool 130 in the bottom of a well, the preferred tool generate substantial pressures, which have been measured in the range of 500–5000 psig, depending on how plugged a liner section was before treatment.

Figure 6:
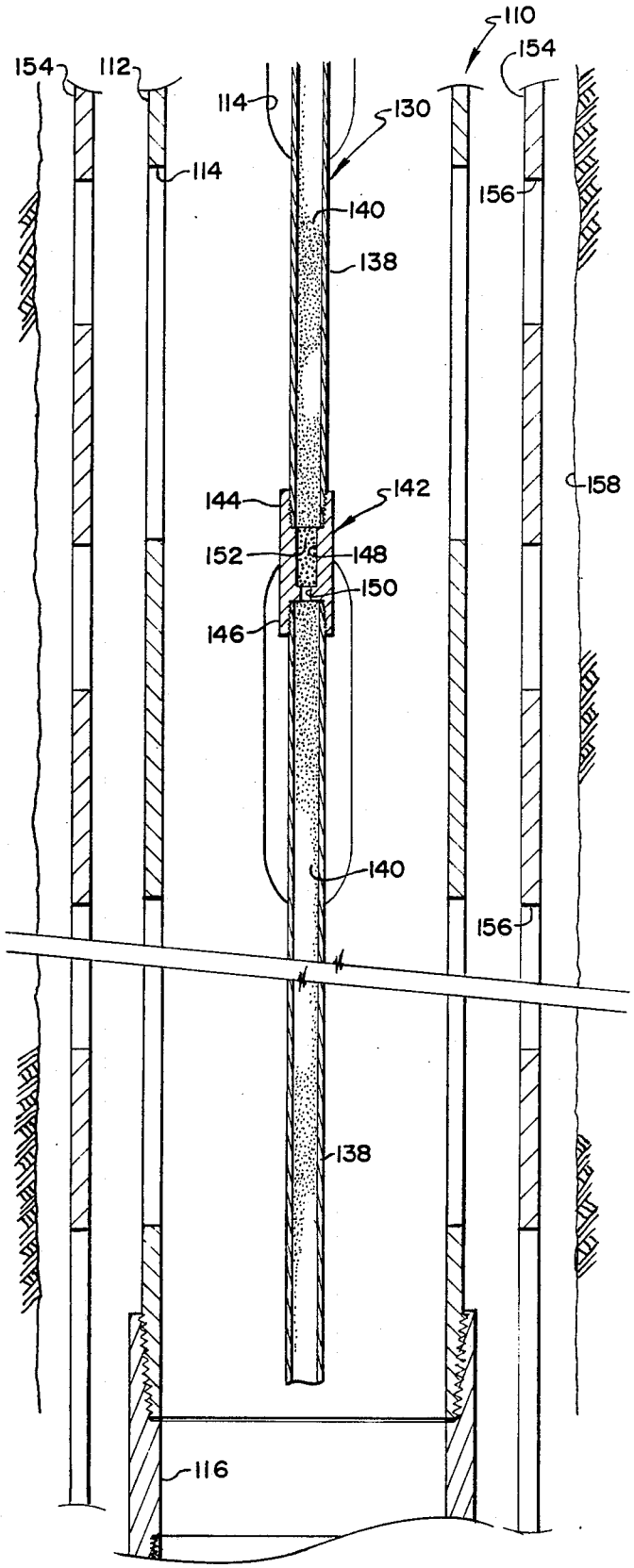
FIG. 6 is an enlarged cross-sectional side view of the device of FIG. 5.

Referring to FIG. 6, there is illustrated one technique for varying the pressure generated by a gas generating tool of this invention. The joints 138 of the tool 130 have therein a charge 140 of propellant material and are connected by a coupling 142. The propellant charges 140 contain a fuel and an oxidizer and are preferably a relatively loosely packed gun powder having a relatively high Propagation rate, e.g. about 1200 feet per second which is slightly greater than the speed of sound in air. When the igniter assembly 126 is energized, it combusts thereby raising the temperature of the powder 140 adjacent thereto This causes the propellant 140 to begin burning thereby liberating high pressure gaseous combustion products which split the upper joint 138 and escape into the well and formation adjacent thereto.

The connector 142 conveniently includes an upper threaded end 144 receiving the lower threaded end of the joint 112, a lower threaded end 146 receiving the upper threaded end of the next subjacent join& 112 and a compartment 148 having a restricted lower end 150 including a compressed black powder element 152 therein. The powder element 152 has a propagation rate substantially lower than 1200 feet per second and is in flame transmitting relation with the propellant charges 140. To this end, the powder element 152 abuts the propellant charges 140.

When the running liner 110 and the tool 130 are lowered into a well and the igniter is energized, combustion is started in the propellant charge 140. Combustion of the upper propellant charge 140 occurs axially, or in a cigarette burning mode, and burns along substantially the entire length of the charge 140 at the propagation rate of the powder thereof. When the flame front reaches the bottom of the uppermost joint 138, the compressed black powder element 152 is ignited. Because the powder element 152 occupies substantially the entire cross section of the compartment 148 and is a rigid material, combustion cannot flare through the compartment 148 and must proceed at the propagation rate of the powder element 152, which is designed to be substantially slower than the rate of the propellant charge 140 for example, 2 to 800 feet per second. Thus, the pressure buildup in and adjacent the tool 130 increases while the uppermost propellant charge 140 is being consumed and either tails off or stabilizes as the powder element 152 is burning. This creates a delay in the tool 130 and, in combination with its small gas capacity, substantially prevents splitting of the uncemented liner 154 having slots 156 therein.

The running liner 110 has a number of advantages. First, the running liner 110 accumulates debris from the tool 130 and allows most of the debris generated by the tool 130 to be removed from the well in a simple and expeditious manner. Second, the slots or openings 114 in the running liner 110 act as a throttle or choke to reduce the pressure applied to the uncemented slotted liner 154 present in the horizontal, inclined or vertical bore hole 158 of a well thereby preventing or minimizing damage to the uncemented slotted liner 154

At one time, it was common to complete wells in the open hole, i.e. without casing cemented through the productive formation. In these situations, a slotted liner was often run into the well opposite the producing formation to prevent the formation from collapsing. In such situations, the perforated or slotted liner is hung from casing cemented above the pay zone This same technique is now becoming common in horizontal wells. In a typical situation where a 5½" O.D.. slotted liner is in place in a well, the running liner 110 is conveniently a string of 2 ⅞" O.D. tubing having conventional screw couplings 116.

Rather than running the liner 110 on the end of the tubing string 136 with the tool 130 therein, the running liner 110 may first be run in the well in a conventional fashion on the bottom of the tubing string 136 and then lowering the tool 130 on a wire line through the tubing string 136 and running liner 110.

The running liner 110 acts to reduce the peak pressures applied to the formation adjacent the slotted liner 154 as shown in Table I.

TABLE I

| | Pressure in psi | |
|---|---|---|
| depth in feet | inside running liner 110 | outside running liner 110 |
| 965 | 4700 | 3500 |
| 1025 | 3500 | 3500 |
| 995 | 3800 | 3500 |
| 810 | 3500 | 1800 |
| 687 | 5800 | 3800 |
| 1905 | 5500 | 4700 |
| 855 | 6000 | 5200 |
| 1945 | 5800 | 3800 |

Referring to FIGS. 7–8, there are illustrated other techniques which can be used in either large diameter tools or small diameter tools for interrupting continuous combustion of the propellant charge of a gas generating tool. A gas generating tool 160 comprises an upper frame or carrier section 162 connected to a cable head assembly (not shown) and receiving an upper charge 164 of propellant material. An igniter or ignition tube (not shown) is connected to a conductor cable or wire line (not shown) for suspending the tool 160 and delivering an electrical signal to activate the igniter thereby initiating combustion of the upper propellant change 164. The upper charge 164 is supported by a partition 168 of any suitable material, such as paper, aluminum or plastic and spaced by an air gap 170 from a second propellant charge 172. The second propellant charge is supported by a partition 174 of any suitable material and spaced by an air gap 176 from a third propellant charge 178 supported by a partition 180. As many propellant charges as are desirable may be provided in the upper carrier 160.

The tool 160 includes a plurality of lower carrier sections 182 connected by couplings 184. The carriers 162, 182 comprises an elongate rigid metallic tubular member or housing 186, 188 open at both ends. The upper end of the upper carrier 162 is closed by the cable head (not shown) while the lower end thereof is closed by the coupling 184. The lower end of the lowermost carrier 182 is closed by a bull plug (not shown). The carriers 162, 182 are thus sealed against entry of liquids from the well bore but split during combustion to allow escape of gases.

The carrier 182 preferably includes an upper propellant charge 190 and then a multiplicity of separate propellant charges 192, air gaps 194 and partitions 196 analogous to the arrangement of charges in the upper carrier 162. It will be evident that the air gaps in the propellant train in the tool 160 cause the tool 160 to sputter rather than deliver a more-or-less constant supply of high pressure gaseous combustion products. This is particularly desirable when cleaning uncemented slotted liners in order to avoid the more-or-less regular splits and bulges noted in such slotted liners when treated with conventional gas generators.

The action of the tool 160 when used to clean uncemented slotted liners should be distinguished from the action of the tool shown in U.S. Pat. No. 3,422,760 when used to fracture a formation. As shown in FIG. 9, the time-pressure profile of the tool of U.S. Pat. No. 3,422,760 includes a series of pressure rise intervals 198 which are seen when each of the individual charges are burning separated by a periods 200 of more-or-less constant pressure when combustion is being transferred from one charge to the next. Ultimately, pressure in the well bore exceeds the formation breakdown pressure 202, the formation fails and combustion gases move into the formation and the pressure in the well bore declines in an interval 204. The reason the pressure increases until the breakdown pressure is reached is that the formation is rather impermeable and only a small quantity of the gas moves into the formation until it fails at the pressure 202.

In contrast, the time pressure profile of the tool 160 of this invention exhibits a series of high relatively constant pressure intervals 206 when one of the charges is burning, followed by an abrupt loss of pressure and a relatively low pressure interval 208. When the next successive charge begins burning, the next high pressure interval 210 is seen. The succession of high and low pressure intervals proceeds until all of the propellant charges in the tool 160 are expended. The pressure in the well bore is rarely, if ever, over the formation breakdown pressure. The reason for the different time pressure profile of the tool of this invention is that the formations completed with slotted liners are much more permeable and take large quantities of gas during a pressure build up phase. Thus, it is difficult to fracture these permeable formations and, indeed, this is not the purpose of the tool 160. Instead, the purpose of the pulsating pressure of the tool 160 is to dislodge material from the slots of the uncemented slotted liner in the well.

The tool 160 also includes another feature of interest. The air gaps in the carriers 162, 182 produce a sputtering discharge of combustion products from the tool 160. It is sometimes desirable to introduce greater delays in the combustion process. This may be accomplished during the transmission of combustion from the upper carrier 162 to the next subjacent carrier 182 through the coupling.

One such technique is illustrated in FIG. 6 and another is shown in greater detail in FIG. 7–8 where the coupling 184 includes a retainer housing 212 secured therein in any suitable fashion, as by the use of set screws 214. An ignition assembly 126 is secured in the housing 212 in any suitable manner, as by the use of set screws 216. The ignition assembly 126 is illustrated in greater detail in FIG. 8 than in FIGS. 5 and 7 and includes an elongate tubular body 218 in an axial passage 220 in the retainer housing 212. An ignition tube 222 having an ignition mix therein is received in an internally threaded lower end of the body 218 and extends into combustion transmitting relation to the propellant charge 190 in the subjacent carrier or joint 182. An O-ring or other seal 224 seals the exterior of the ignition tube 222 to the body 218.

The body 218 provides an axial passage 226 having the piston 134 closely fit therein and sealed with an O-ring 228. A shear pin 230 extends through the piston 134 and prevents depression of the piston 134 until a predetermined force is applied to the piston 134. The piston 134 includes a firing pin point 232 which contacts an impact primer 234 at the bottom of the passage 226. The primer 234 ignites an ignition mixture 236 in a passage 238 communicating with the upper end of the ignition tube 222 and thus ignites the upper propellant charge 190.

Operation of the tool 160 should now be apparent. The tool 160 is run into a well, either directly into the well or inside a slotted running liner. When the igniter (not shown) is energized, it combusts thereby raising the temperature of the charge 164 adjacent thereto. This causes the propellant 164 to begin burning thereby liberating high pressure gaseous combustion products which split the tube 186 in the vicinity of the charge 164 and escapes into the well, pushing bore hole liquid adjacent the tool 160 through any uncemented slotted liner therein and then into the formation adjacent thereto.

Sometime before the end of combustion of the charge 164, the partition 168 gives way allowing hot combustion products and burning propellant pieces to travel downwardly in the tube 186 to ignite the next lower charge 172. During combustion of the charge 164, pressure adjacent the tool 160 is at a relatively high level shown by the interval 206 in FIG. 9. As combustion is being transferred to the next subjacent charge 172, pressure declines in the interval 208. Thus, combustion of the propellant charges in the carrier 162 causes a sputtering discharge of high pressure gaseous combustion products that are well suited to dislodge undesirable accumulations in the openings of an uncemented slotted liner. When combustion of the upper carrier 162 is substantially over, high pressure combustion products shear the pin 230 allowing the piston 134 to travel downwardly in the passage 226 to impact the primer 234 and start combustion of propellant charges in the next lower carrier 182.

It will be evident that the ignition mechanism in the coupling 184 may be used to initiate combustion of a gas generating stimulation tool rather than simply transmit combustion. In this event, the shear pin 230 is selected to fail at the imposition of a pressure in the well bore than can be reached by simply pumping liquid into the well.

Referring to FIG. 10, there is illustrated a simple technique for varying the pressure of a gas generating tool 240. The tool 240 comprises upper and lower joints 242, 244 connected by a coupling 246. The upper joint 242 includes a partition wall 248 above the top of the coupling 246 and a granular propellant charge 250 supported on the wall 248. The lower joint 244 includes a granular propellant material 252 supported by a partition wall (not shown). The coupling 246 conveniently threadably connects the joints 242, 244 and provides a central axial passage 254. The partition wall 248 and coupling 246 provide an air gap above the propellant charge 252. Thus, ignition of the charge 250 causes a pressure buildup adjacent the tool. When the charge 250 is nearly consumed, combustion of the charge 252 begins with a definite pause in combustion and consequent fall in pressure adjacent the tool 240.

Although this invention has been disclosed and described in its preferred forms with a certain degree of particularity, it is understood that the present disclosure of the preferred forms is only by way of example and that numerous changes in the details of operation and in the combination and arrangement of parts may be resorted to without departing from the spirit and scope of the invention as hereinafter claimed.

I claim:

1. A method of treating a well penetrating a subterranean formation, comprising lowering into the well a tool comprising first, second and third discrete propellant charges, the first and second propellant charges including first and second ignition tubes extending substantially therethrough having an ignition mix therein, a first combustion transfer tube in combustion transferring relation with the first charge and in combustion transferring relation with the second charge, and a second combustion transfer tube in combustion transferring relation with the second charge and in combustion transferring relation with the third charge; and igniting a first of the charges and then igniting the second charge from the combustion products from the first combustion transfer tube and then igniting the third charge from the combustion products of the second charge at a time when the first charge is still burning.

2. A method of treating a well penetrating a subterranean formation, comprising lowering into the well a tool comprising first, second and third discrete propellant charges, the first and second propellant charges including first and second ignition tubes extending substantially therethrough having an ignition mix therein; and igniting a first of the charges from combustion products from the first ignition tube; and then igniting the second ignition tube from combustion products from the first ignition tube; and then igniting the second charge from combustion products from the second ignition tube, and then igniting the third charge from the combustion products of the second charge at a time when the first charge is still burning.

3. The method of claim 2 wherein the third propellant charge includes a third ignition tube having an ignition mix therein and wherein the third ignition tube is ignited from combustion products from the second ignition tube and the third charge is ignited from combustion products form the third ignition tube.

4. Apparatus for treating a well penetrating a subterranean formation, comprising a series of elongate vertically spaced propellant charges for generating a large quantity of high pressure gaseous combustion products;

an igniter for initiating combustion of a first of the propellant charges including an ignition tube having a combustible material therein, the ignition tube extending axially substantially though the first charge; and means for transmitting combustion of the first charge to a second of the charges, including a combustion transferring tube extending into the first charge and extending into the second charge and having a combustible material therein.

5. The apparatus of claim 4 wherein the ignition tube includes a lower end radially spaced from an upper end of the combustion transferring tube.

6. The apparatus of claim 4 wherein the ignition tube includes a lower end axially spaced from an upper end of the combustion transferring tube.

7. The apparatus of claim 4 wherein the first charge comprises a blind passage opening through one end thereof, the combustion transferring tube extending into the blind passage.

8. The apparatus of claim 4 wherein the combustion transferring tube includes a second ignition tube extending axially through a substantial part of the second charge, a transfer tube and means connecting the transfer tube to the second ignition tube, the transfer tube extending into the first charge.

9. The apparatus of claim 8 wherein the transfer tube comprises a closed upper end in the first charge, an ignition material in the upper end of the first charge and means supporting the ignition material in the upper end of the first charge and leaving a lower end of the transfer tube empty.

10. The apparatus of claim 8 wherein the connecting means comprises a telescoping joint between the transfer tube and the second ignition tube.

11. The apparatus of claim 10 wherein the connecting means further comprises a resilient seal in the telescoping joint for preventing liquid entry into the transfer tube and second ignition tube.

12. A method of cleaning an uncemented slotted liner in a well bore penetrating a subterranean formation, comprising lowering a running liner having a plurality of openings therein into the slotted liner;

lowering the propellant charge into the running liner after lowering the running liner into the slotted liner;

igniting the propellant charge and producing a quantity of high pressure combustion products;

delivering the combustion products through the openings of the running liner and thereby throttling the pressure of the combustion products; and delivering the combustion products through the openings of the slotted liner.

13. The method of claim 12 wherein the step of delivering combustion products through the openings of the running liner and thereby throttling the pressure of the combustion products comprises reducing the pressure of the combustion products between the slotted liner and the running liner to a value below the pressure of the combustion products between the running liner and the propellant charge.

14. A method of cleaning an uncemented slotted liner in a well bore penetrating a subterranean formation, comprising lowering a running liner having a plurality of openings therein and a propellant charge into the slotted liner;

igniting the propellant charge and producing a quantity of high pressure combustion products and a quantity of debris;

delivering the combustion products through the openings of the running liner and thereby throttling the pressure of the combustion products; and delivering the combustion products through the openings of the slotted liner; and collecting a substantial part of the debris in the running liner and then removing the running liner and the debris collected therein from the well bore.

15. A method of cleaning an uncemented slotted liner in a well bore penetrating a subterranean formation, comprising lowering into the slotted liner a propellant charge having the capability of delivering not more than about 1000 cubic inches of gaseous combustion products measured at standard temperature and pressure per linear foot of propellant charge;

igniting the propellant charge and producing less than about 1000 cubic inches of gaseous combustion products measured at standard temperature and pressure per linear foot of propellant charge;

periodically changing the rate of combustion of the propellant charge to vary the pressure adjacent the slotted liner; and delivering the combustion products through the openings of the slotted liner.

16. The method of claim 15 wherein the igniting and producing step produces less than about 500 cubic inches of gaseous combustion products measured at standard temperature and pressure per linear foot of propellant charge.

17. Apparatus for cleaning an uncemented slotted liner in a well bore penetrating a subterranean formation, comprising a propellant charge having the capability of delivering not more than about 1000 cubic inches of gaseous combustion products measured at standard temperature and pressure per linear foot of propellant charge;

means for igniting the propellant charge and producing less than about 1000 cubic inches of gaseous combustion products measured at standard temperature and pressure per linear foot of propellant charge; and means for periodically changing the rate of combustion of the propellant charge to vary the pressure adjacent the slotted liner.

18. The apparatus of claim 17 wherein the propellant charge comprises first and second discrete propellant charges, and further comprising first and second carriers receiving the first and second propellant charges and a coupling securing the first and second carriers together, the means for periodically changing the rate of combustion being in the coupling.

19. The apparatus of claim 17 wherein the propellant charge comprises first and second discrete propellant charges exhibiting first and second propagation rates and the means for periodically changing the rate of combustion including a third combustible charge in combustion transmitting relation between the first and second propellant charges, the third charge having a propagation rate substantially slower than the first and second rates.

20. The apparatus of claim 17 wherein the propellant charge comprises first and second discrete propellant charges and wherein the means for periodically changing the rate of combustion includes means transmitting combustion of the first charge to the second charge and reducing the propagation rate of the apparatus including means responsive to pressure generated by the first propellant charge for igniting the second propellant charge.

21. The apparatus of claim 20 wherein the pressure responsive means comprises a housing having a piston mounted for movement in a path in the housing in response to pressure in the first carrier, the piston having one end exposed to pressure in the first carrier and a second end, an impact primer in the housing and in the path of movement of the piston and an ignition mixture in combustion receiving relation with the primer and in combustion transmitting relation with the second propellant charge.

22. The apparatus of claim 17 wherein the propellant charge comprises a hollow carrier having a series of propellant charges spaced along the carrier defining air gaps between the propellant charges, the means for periodically changing the rate of combustion comprising the air gaps.

23. The apparatus of claim 17 wherein the propellant charge comprises a hollow carrier having a plurality of axially spaced partition walls, a plurality of propellant charges supported on the partition walls, the partition walls defining an air gap with the next subjacent propellant charge, the means for periodically changing the rate of combustion comprising the air gaps.

24. Apparatus for treating a well penetrating a subterranean formation, comprising first and second propellant charges exhibiting first and second propagation rates for generating a quantity of high pressure gaseous combustion products;

an igniter for initiating combustion of a first of the propellant charges; and means for transmitting combustion of the first charge to the second charge and reducing the propagation rate of the apparatus, including means responsive to pressure in the first carrier for igniting the second propellant charge.

25. The apparatus of claim 24 wherein the first and second carriers include elongate tubes receiving the first and second propellant charges therein and further comprising a connector coupling the first and second carriers together, the connector having the pressure responsive means therein.

26. The apparatus of claim 24 wherein the pressure responsive means comprises a housing having a piston mounted for movement in a path in the housing in response to pressure in the first carrier, the piston having one end exposed to pressure in the first carrier and a second end, an impact primer in the housing and in the path of movement of the piston and an ignition mixture in combustion receiving relation with the primer and in combustion transmitting relation with the second propellant charge.

27. Apparatus for treating a well penetrating a subterranean formation, comprising first and second carriers having first and second propellant charges therein for generating a quantity of high pressure gaseous combustion products;

an igniter for initiating combustion of a first of the propellant charges; and a connector securing the first and second carriers in axial relation and having therein means for transmitting combustion of the first charge to the second charge and reducing the propagation rate of the apparatus including means in the connector responsive to pressure in the first carrier for igniting the second propellant charge.

28. Apparatus for treating a well penetrating a subterranean formation, comprising first and second carriers having first and second propellant charges therein for generating a quantity of high pressure gaseous combustion products;

an igniter for initiating combustion of a first of the propellant charges; and a connector securing the first and second carriers in axial relation and providing an air gap therein between the first and second propellant charges and having therein means for transmitting combustion of the first charge to the second charge and reducing the propagation rate of the apparatus, the last mentioned means including the air gap.

* * * * *